United States Patent [19]

Scheerhorn

[11] 3,998,508

[45] Dec. 21, 1976

[54] GANG LOCKING MECHANISM

[75] Inventor: Douglas Scheerhorn, Grand Rapids, Mich.

[73] Assignee: Steelcase Inc., Grand Rapids, Mich.

[22] Filed: Oct. 2, 1975

[21] Appl. No.: 618,927

[52] U.S. Cl. ..... 312/221; 312/217

[51] Int. Cl.[2] ..... E05B 65/46

[58] Field of Search ..... 312/215–222; 70/78, 79, 85

[56] References Cited

UNITED STATES PATENTS

| | | | |
|---|---|---|---|
| 2,225,243 | 12/1940 | Zottel | 312/219 |
| 3,371,974 | 3/1968 | Vermeersch | 312/221 |
| 3,497,280 | 2/1970 | Olree et al. | 312/219 |
| 3,560,068 | 2/1971 | Ostrom | 312/217 |

*Primary Examiner*—Casmir A. Nunberg

*Attorney, Agent, or Firm*—Price, Heneveld, Huizenga & Cooper

[57] ABSTRACT

A gang locking mechanism for use with a cabinet having a plurality of slidably mounted drawers includes a single drawer mounted control rod operatively connected at one end to a master lock supported at the front panel of one of the drawers. The other end of the control rod engages a pivot plate secured to the inner face of the rear wall of the cabinet when the drawer is in a closed position. Linkage members extend from the pivot plate and engage corner mounted locking bars. The locking bars are mounted for limited pivotal movement about their vertical axes and include a plurality of hook-like clips adapted to lock the drawers in a closed position.

15 Claims, 5 Drawing Figures

GANG LOCKING MECHANISM

BACKGROUND OF THE INVENTION

This invention relates to locking mechanisms, and more particularly to gang locking mechanisms for cabinets of the type including a plurality of slidably mounted drawers.

Various forms of cabinet structures are known which include a plurality of vertically stacked, slidably mounted drawers. The drawers may be of different dimensions to provide bulk storage space, file folder storage space, stationary storage, etc. It is considered advantageous with such cabinet/drawer arrangement to provide a single key-operated lock serving, to lock all of the drawers in a closed position.

Heretofore, such drawer gang locking mechanisms have generally employed vertically extending lock bars which through a linkage or control rod arrangement are moved in a vertical direction or are pivoted upon actuation of a key-operated master lock. Each lock bar includes some type of latch or stop arrangement cooperating with each drawer to positively retain them in a closed position. The master lock is typically located at the top or on the side of the cabinet itself. The lock bars and linkage have generally been located along the forward or front panel of the cabinet to make the linkage mechanism less complex. As a result, it is possible to reach the operative portions of the gang locking mechanism with a screwdriver or other thin rod-like tool, and thereby override the locking mechanism. This is particularly true with the master lock mounted on the cabinet since one can insert the tool between the drawer and cabinet opening edge and force the linkage laterally or upwardly to pivot or raise the lock bar.

The U.S. patent to Zottel, U.S. Pat. No. 2,225,243, entitled "DESK" and issued Dec. 17, 1940 is an attempt to obviate this drawback by mounting the master lock and linkage in the drawer and provide for a linkage that extends to the rear of the drawer so that the lock bars are at the rear of the cabinet. Unfortunately, Zottel requires a separate linkage for each side of the drawer, where a lock bar is provided at each side of the master lock drawer. Also, Zottel could not coordinate the bell crank linkage with a pivot type lock bar and had to use vertical movement lock bars.

With all such systems employing a vertical movement lock bar or latch mechanisms which must be lifted for operation, a relatively high key rotational force is present. As the number of drawers and the overall height of the cabinet increases, the length, and therefore the weight, of the lock bar increases. An operator must lift this weight through rotation of the key in the master lock. Therefore, as the size of the cabinet increases, the key rotation force must necessarily also increase.

With the gang locking systems of the type exemplified by the above-referenced U.S. Patent and with various other forms of gang locking arrangements which employ a plurality of control rods, linkage members and latch bars or spring loaded latches, the overall arrangement is relatively complex, may be subject to jamming, and due to the number of components involved, may result in installation difficulties.

SUMMARY OF THE INVENTION

In accordance with the present invention, a simple drawer mounted gang locking mechanism is provided for a cabinet arrangement which is capable of locking all available drawers from one drawer lock location and which is highly resistant to unauthorized entry. Essentially, the gang locking mechanism includes a single, crank control rod extending from a lock drawer front panel rearwardly of the drawer. The end of the control rod opposite the lock is adapted to engage a pivot plate secured to the face of the rear wall of a cabinet behind the drawer when the drawer is in a closed position. Linkage members extend outwardly from the pivot plate and operably engage lock means mounted adjacent the rear cabinet corners. The lock means extend in a vertical direction relative to the cabinet and are mounted for limited pivotal movement about their vertical axes. Upon rotation of the control rod, the lock means are pivoted and lock the drawers in a closed position.

DETAILED DESCRIPTION OF THE PREFERRED EMBODIMENT

Figure 1:
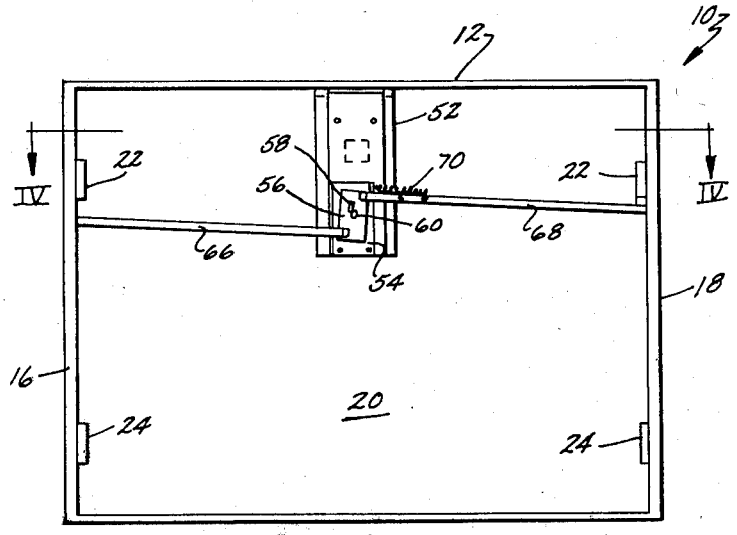
FIG. 1 is a front elevational view of a cabinet employing a gang locking system in accordance with the present invention.
Figure 5:
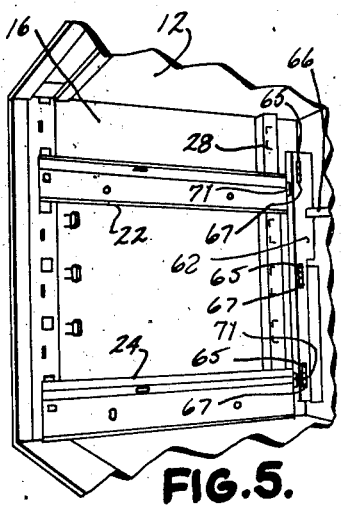
FIG. 5 is a fragmentary, perspective view of the cabinet of FIG. 1.

With reference to the drawings, a cabinet, generally designated 10, and including the gang locking system of the present invention is illustrated in FIG. 1. The cabinet includes a top panel 12, a bottom panel 14, side panels 16, 18 and a rear panel 20. Secured to the inner faces of side panels 16 and 18 are drawer guides 22 and 24. As shown in FIG. 5, the drawer guides 22, 24 may be secured to vertically extending channel members 26 and 28. This mounting arrangement permits the vertical spacing between the guides 22 and 24 to be varied to accommodate drawers of different height and dimensions.

Figure 3:
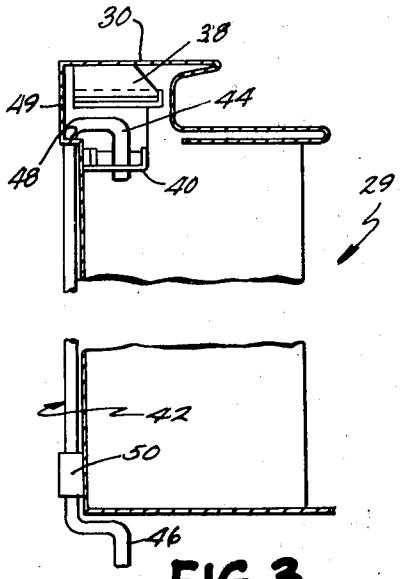
FIG. 3 is a broken cross section taken along line III—III of FIG. 2.
Figure 2:
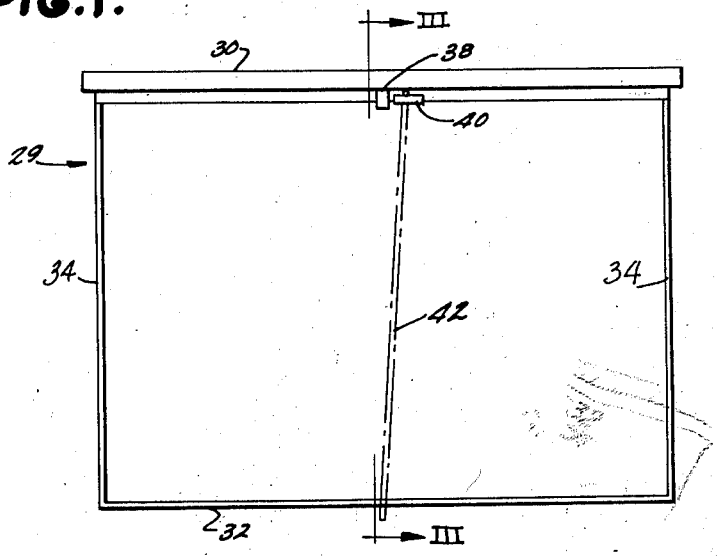
FIG. 2 is a plan view of a drawer for use with the cabinet of FIG. 1.

The guides, which are of a conventional type, rollably or slidably receive a plurality of drawers. One of the drawers is a master lock drawer 29 illustrated in FIGS. 2 and 3. The master lock drawer 29 includes a front panel 30, a rear panel 32, side panels 34 and a bottom panel 36. A conventional master lock 38 is supported intermediate the ends of the front panel 30. Conventional master lock 38 is of the key-operated type and includes a reciprocating bracket 40. Rotation of a key in the lock 38 results in translational movement of the bracket 40.

A control rod 42 extends from the bracket 40 of the master lock 38 rearwardly under the bottom panel 36 of the drawer. The control rod 42 is operatively connected to the bracket 40 at a U-shaped crank portion 44. The opposite end of the control rod 42 terminated adjacent the rear panel 32 of the drawer in a cranked portion 46. As shown, the lower panel 36 of the drawer is stepped at 48 thereby having a stepped cross section so that the control rod 42 may extend underneath the panel. The resulting lip-like portion 49 of the drawer protects the rod 42 and prevents interference between the rod and a drawer mounted immediately below the master lock drawer. The rod 42 is not directly accessible from the front of the drawer since it extends rearwardly from the lip 49. A strap 50 secures the control rod 42 adjacent its rear end to the underside of the panel 36. Therefore, upon rotation of the key in the master lock 38, the bracket 40 is translated, thereby pivoting the control rod 42.

As best seen in FIG. 1, a vertically extending channel member 52 is positioned centrally of the rear wall or panel 20 of the cabinet 10. Secured to the face of the channel 52 is a support plate 54. Pivotally mounted to the support plate 54 is a pivot plate 56. The pivot plate 56 is formed with an eccentrically positioned aperture 58. The aperture 58 is positioned and dimensioned so as to receive the cranked end 46 of the control rod when the master drawer is moved to the closed position. A bolt or other suitable means 60 is employed to rotatably or pivotably mount the pivot plate 56 to support plate 54.

Figure 4:
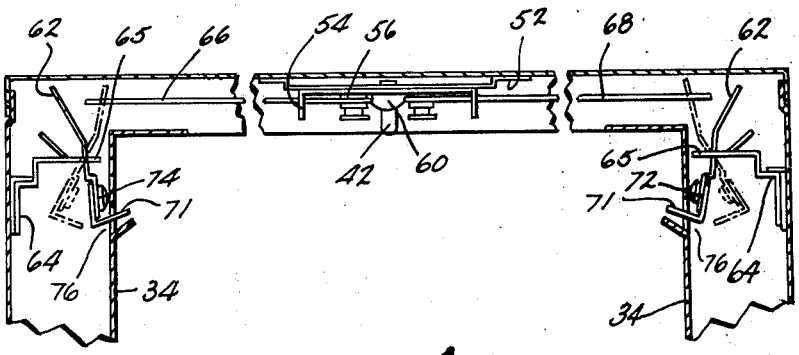
FIG. 4 is a cross-sectional view taken along line IV—IV of FIG. 1 with the drawer of FIG. 2 installed.

As best seen in FIGS. 4 and 5, a pair of lock bars 62 are mounted for limited pivotal movement about their vertical axes at the rear corners of the cabinet 10. Each lock bar 62 is supported at spaced positions along its center line by a plurality of hook-like elements 64. The hook-like elements 64 are welded or otherwise suitably secured to the side panels 16 and 18 of the cabinet. The elements 64 each have a hooked portion 65 received within one of a plurality of slots 67 formed at vertically spaced locations in the lock bars 62. This arrangement very simply mounts the bars for limited pivotal movement about their vertical axes.

A pair of linkage members 66 and 68 are pivotally secured at diametrically opposed points to the pivot plate 56. The opposite ends of the linkage members 66 and 68 are connected to the corresponding lock bars 62, by a simple slotted connection. A spring 70 is secured between the pivot support plate 54 and linkage member 68 to bias the pivot plate to the unlocked position shown in FIG. 1.

As best seen in FIG. 4, when the master drawer is slid to the closed position, the cranked end 46 of control rod 42 is received within the aperture 58 of the pivot plate 56. The pivot plate 56 is at least partially blocked by the rear panel of the master lock drawer when it is engaged by the control rod. Also the cranked portion 46 extends upwardly behind the rear drawer panel. These features result in the main portions of the mechanism being almost totally inaccessible from the front or sides of the cabinet.

Upon rotation of the key and the master lock, the pivot plate 56 is pivoted about its axis 60, thereby extending or moving the rods 66 and 68 in an outward direction. As a result, each lock bar 62 pivots about its vertical axis inwardly towards the sides 34 of the drawer.

Each lock bar 62 includes a plurality of vertically spaced, hook-like locking clips or locking tabs 71. These hook-like clips 71 are secured along the inwardly pivoting edge 72 of the lock bar by suitable fasteners 74. As shown, the hook-like clips or locking tabs 71 cooperate with slots 76 located in the sides 34 of each drawer to positively secure the drawers in a closed and locked position.

When the lock bars 62 have been pivoted to their locking position, as shown in solid lines in FIG. 4, the ends of the hook-like clips 71 are directed generally toward the rear wall 20 of the cabinet. The hooked portions therefore positively engage and receive the drawer sides.

Therefore, each of the drawers and the hook-like clips or locking tabs which are secured to the locking bars function as interengaging blocking means. The drawers and the locking bars disengage when the bars are rotated to the unblocking position illustrated in phantom in FIG. 4 and engage when rotated to the blocking or locking position as shown in solid lines in FIG. 4. Each of the locking tabs or hook-like clips engages with its corresponding drawer slot and blocks movement of the drawer when the drawer is in a closed position.

As is readily apparent, the pivot plate 56 may be secured at any position along the rear wall 20. By forming the lock bars 62 with a plurality of vertically spaced slots the point of connection between the lock bars and the linkage members may be varied depending upon the positioning of the pivot plate. Further, by employing separate hook-like clips to positively engage the sides of the drawers, the vertical spacing of the hook-like clips may be varied to accommodate drawers of different dimensions.

The overall gang locking mechanism, including the single master lock, the single control rod, the single pivot plate, the pair of linkage members, and the pair of lock bars constitute a simple easily manufactured arrangement which is not subject to jamming. Further, since the main components of the gang locking mechanism are located either in the drawer front panel or hidden along the rear wall of the cabinet, a screwdriver or other thin rod-like tool cannot easily be employed to override the locking mechanism. In fact, with the exception of the key operated master lock 38, all operative portions of the gang locking mechanism are virtually unreachable absent physical cutting of the cabinet structure. Since the lock bars operate by pivoting about their vertical axes, the overall vertical dimension of the cabinet system may be increased without any increase in the key rotational forces necessary to actuate the mechanism. While control rod 42 is exposed along the bottom of drawer 29, it cannot be activated by pushing in any direction. Rather, it would have to be rotated and it would be impossible to insert a gripping tool between two drawers to grip and rotate the rod.

It can therefore be seen that the cabinet and gang locking mechanism of the present invention is a simple, non-complex structure having fewer operating parts when compared with the systems heretofore available. The gang locking mechanism is adaptable to cabinets having varying numbers of drawers without a corresponding increase in key rotation forces. Also, since the operative portions of the mechanism are hidden and generally unreachable from the front of the cabinet, they are not easily overridden and increased security results therefrom.

The embodiments of the invention in which an exclusive property or privilege is claimed are defined as follows:

1. In an article of furniture such as a desk, cabinet or the like having a rear wall and side walls, a plurality of vertically stacked slidable drawers, and a gang locking mechanism, said article and locking mechanism comprising:

one of said plurality of drawers being a master lock drawer having a front panel and bottom panel;

a master lock mounted in said master lock drawer behind said front panel thereof;

a single control rod mounted in said master lock drawer, operably connected to said master lock and extending from said master lock in a rearward direction along said bottom panel of said master lock drawer;

a pivot plate pivotally mounted on the inner face of said rear wall of the cabinet, said pivot plate and said control rod including mating engaging means for selectively engaging and disengaging when said master lock drawer is closed and opened, respectively, whereby said pivot plate is operatively associated with said control rod when said lock drawer is in a closed position;

linkage means connected to and extending outwardly from said pivot plate;

locking means supported in said cabinet for limited movement between a locking position and an unlocking position, said locking means being operatively connected to said linkage member;

said locking means being adjacent said plurality of drawers, each of said drawers and said locking means comprising interengaging blocking means which disengage when said locking means is in said unlocking position and which engage when said locking means is in said locking position for blocking the movement of said drawers whereby each of said plurality of drawers is locked in a closed position upon turning of said master lock.

2. The article of claim 1 in which said locking means comprises two locking bars mounted in said article at the rear thereof, one being located to each side of said master lock drawer, said linkage means comprising two linkage systems, one connected to and extending from one side of said pivot plate and being operably connected to one of said lock bars, and the other being connected to and extending from the other side of said pivot plate and being operably connected to said other lock bar.

3. The article of claim 2 in which said lock bars are mounted in said article for pivotal movement about a vertical axis whereby rotation of said pivot plate also causes said lock bars to rotate about their vertical axes between said locking and unlocking positions.

4. The article of claim 3 wherein said lock bars have vertically spaced slots formed therein;

means secured to the article walls for supporting each of said lock bars at said slots for limited pivotal movement about a vertical axis adjacent a rear corner of said article.

5. The article of claim 2 wherein said front panel of said master lock drawer extends below the level of said bottom panel and said control rod extends under said bottom panel of said master lock drawer behind said extending portion of said front panel.

6. An article as defined by claim 1 wherein said mating engaging means of said pivot plate and said control rod comprise said control rod having a cranked portion and said pivot plate having an eccentrically located aperture positioned to receive the end of said cranked portion when said master lock drawer is closed.

7. An article as defined by claim 6 further including another linkage member, both of said linkage members being pivotally connected to said pivot plate at diametrically opposed points, and another locking means operatively connected to said another linkage member.

8. An article as defined by claim 7 wherein said interengaging blocking comprises a plurality of vertically spaced, inwardly angled locking tabs secured to said lock bars along one edge thereof and each of said drawers including side panels having slots formed therein and positioned so as to receive said locking tabs when said lock bars are in said locking position.

9. An article as defined by claim 1 wherein said interengaging blocking means comprises a plurality of vertically spaced, inwardly angled locking tabs secured to said lock bars along one edge thereof and each of said drawers including side panels having slots formed therein and positioned so as to receive said locking tabs when said lock bars are in said locking position.

10. An article storage device, comprising:

a rectangular cabinet having an open front;

a plurality of vertically spaced drawer guides mounted on the side walls of said cabinet;

a plurality of drawers having glides slidably received in said guides, one of said drawers having a master lock supported on the inner face of the front panel thereof;

a control rod operatively connected to said master lock and extending rearwardly beyond the rear panel of said one of said drawers;

an elongated lock bar supported for limited pivotal movement about its vertical axis adjacent a rear corner of said cabinet;

means operatively connected to said control rod when said one of said drawers is in the closed position for pivoting said lock bar; and locking means positioned on said lock bar for securing each of said drawers in a closed position upon actuation of said master lock.

11. An article storage device as defined by claim 10 wherein each of said drawers includes slots formed in the rear of their side panels and said locking means comprises a plurality of vertically spaced, inwardly angled tabs on said lock bar along one edge thereof, said tabs adapted to positively engage the slot in the sides of said drawers.

12. An article storage device as defined by claim 11 wherein said means for pivoting said lock bar includes:

a pivot plate rotatably secured to the inner face of the rear panel of said cabinet; and a linkage member interconnecting said pivot plate and said lock bar.

13. An article storage device as defined by claim 12 wherein said control rod includes cranked portions at each end and said control rod extends under the bottom panel of said drawer.

14. An article storage device as defined by claim 13 wherein said pivot plate has an eccentrically positioned aperture for receiving one of said cranked ends of said rod.

15. An article storage device as defined by claim 14 further including another linkage member, said linkage members connected to said pivot plate at diametrically opposed points; and another lock bar supported for limited pivotal movement about a vertical axis adjacent the other rear corner of said cabinet.

* * * * *

UNITED STATES PATENT AND TRADEMARK OFFICE

CERTIFICATE OF CORRECTION

PATENT NO. : 3,998,508

DATED : December 21, 1976

INVENTOR(S) : Douglas Scheerhorn

It is certified that error appears in the above-identified patent and that said Letters Patent are hereby corrected as shown below:

Column 1, line 14:

After "such" insert ---a---;

Column 2, line 4:

After "lock" insert ---in a ---;

Column 2, line 61:

"terminated" should be ---terminates---;

Column 5, line 10:

After "said" , second occurrence insert -- master --;

Column 6, line 2:

After "blocking" insert ---means---.

Signed and Sealed this

Nineteenth Day of April 1977

[SEAL]

*Attest:*

RUTH C. MASON
*Attesting Officer*

C. MARSHALL DANN
*Commissioner of Patents and Trademarks*